US006198889B1

(12) United States Patent
Yu et al.

(10) Patent No.: US 6,198,889 B1
(45) Date of Patent: Mar. 6, 2001

(54) FLEXIBLE IMAGING MEMBER BELT SET PREVENTION

(75) Inventors: Robert C. U. Yu; Satchidanand Mishra, both of Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/451,723

(22) Filed: Dec. 1, 1999

(51) Int. Cl.[7] ..... G03G 15/00
(52) U.S. Cl. ..... 399/75; 399/162
(58) Field of Search ..... 399/75, 159, 162, 399/164, 167, 26, 37; 430/58, 127, 130

(56) References Cited

U.S. PATENT DOCUMENTS 5,240,532 8/1993 Yu ..... 156/137
5,376,990 12/1994 Savage ..... 355/208
6,068,722 * 5/2000 Yu et al. ..... 430/127

* cited by examiner

*Primary Examiner*—Sophia S. Chen
*Assistant Examiner*—Hoan Tran
(74) *Attorney, Agent, or Firm*—John L. Haack; Peter H. Kondo

(57) ABSTRACT

A process including: providing an electrically powered imaging system including a flexible electrostatographic imaging member belt including at least one layer including a thermoplastic polymer matrix, an imaging surface and a back surface, and at least two rotatable belt support members, each support member having an arcuate contacting surface in contact with the back surface of the imaging belt; providing electrical power to the imaging system, the imaging system having operating modes including a copying mode and at least one non-copying mode; and cycling the belt at low speed around the belt support members after the imaging system has continuously been in the at least one non-copying mode for at least about 1.5 hours.

19 Claims, 2 Drawing Sheets

FLEXIBLE IMAGING MEMBER BELT SET PREVENTION

BACKGROUND OF THE INVENTION

This invention relates in general to electrostatography, and more specifically, to a process for preventing imaging member belt set in an imaging machine environment.

Flexible electrostatographic belt imaging members are well known in the art. Typical electrostatographic flexible belt imaging members include, for example, photoreceptors for electrophotographic imaging systems, electroreceptors such as ionographic imaging members for electrographic imaging systems, and intermediate image transfer belts for transferring toner images in electrophotographic and electrographic imaging systems. These belts are usually formed by cutting a rectangular sheet from a web containing at least one layer of thermoplastic polymeric material, overlapping opposite ends of the sheet, and welding the overlapped ends together to form a welded seam. The seam extends from one edge of the belt to the opposite edge. Generally, these belts comprise at least a supporting substrate layer and at least one imaging layer comprising thermoplastic polymeric matrix material. The "imaging layer" as employed herein is defined as the dielectric imaging layer of an electroreceptor belt, the transfer layer of an intermediate image transfer belt and, the charge transport layer of an electrophotographic belt. Thus, the thermoplastic polymeric matrix material in the imaging layer is located in the upper portion of a cross section of an electrostatographic imaging member belt, the substrate layer being in the lower portion of the cross section of the electrostatographic imaging member belt.

Flexible electrophotographic imaging member belts are usually multilayered photoreceptors that comprise a substrate, an electrically conductive layer, an optional hole blocking layer, an adhesive layer, a charge generating layer, and a charge transport layer and, in some embodiments, an anti-curl backing layer is desirable for imaging member flatness. Optionally, an overcoating layer may also be formed over the charge transport layer to provide wear protection. One type of multilayered photoreceptor comprises a layer of finely divided particles of a photoconductive inorganic compound dispersed in an electrically insulating organic resin binder. A typical layered photoreceptor having separate charge generating (photogenerating) and charge transport layers is described in U.S. Pat. No. 4,265,990, the entire disclosure thereof being incorporated herein by reference. In one embodiment, the charge transport layer is located at the top and over the charge generating layer of the imaging member. In an alternative embodiment, the charge generating layer is positioned on top of the charge transport layer. The charge generating layer is capable of photogenerating charge and injecting the photogenerated charge into the charge transport layer.

Although excellent toner images may be obtained utilizing multilayered seamed belt photoreceptors, it has been found that as more advanced, higher speed electrophotographic copiers, duplicators and printers were developed, fatigue induced cracking of the charge transport layer and cracking initiation at the welded seam area were frequently encountered during photoreceptor belt cycling. Seam cracking initiation has also been found to rapidly propagate into catastrophic seam delamination as a result of continuing imaging belt fatigue which shortens belt service life. Dynamic fatigue induced imaging layer cracking and seam cracking and delamination may also occur in ionographic imaging member belts and intermediate image transfer belts.

The seamed flexible electrostatographic imaging member belt is usually fabricated from a sheet cut from a web. The sheets are generally rectangular in shape. All edges may be of the same length or one pair of parallel edges may be longer than the other pair of parallel edges. The sheets are formed into a belt by joining overlapping opposite marginal end regions of the sheet. A seam is typically produced in the overlapping marginal end regions at the point of joining. Joining may be effected by any suitable means. Typical joining techniques include welding (including ultrasonic), gluing, taping, pressure heat fusing, and the like. Ultrasonic seam welding is generally the preferred method for joining imaging member belts because it is rapid, clean (no solvents) and produces a thin and narrow seam. Another reason that the ultrasonic seam welding process is preferred is because it causes generation of heat at the contiguous overlapping end marginal regions of the sheet to maximize melting of one or more layers in the contacting overlapped ends of the imaging member sheet, which facilitates direct substrate to substrate fusing at the overlapped ends to form a seam having strong bond strength. For reason of simplicity, the discussion hereinafter will focus primarily on electrophotographic imaging members as a representation of electrostatographic imaging members.

When the overlapped ends of the cut sheet are ultrasonically welded to form a belt, the seam of the flexible multilayered electrophotographic imaging member, due to material discontinuity and excess localized seam thickness, can initiate crack formation and eventually delaminate during extended bending and flexing over small diameter belt support rollers of an imaging machine or when subjected to lateral forces caused by rubbing contact with stationary web edge guides of a belt support module during cycling. Mechanical failure due to seam cracking and delamination is further aggravated when the belt is employed in an electrophotographic imaging system utilizing a cleaning device such as a cleaning blade. Alteration of materials in the various photoreceptor belt layers such as the conductive layer, hole blocking layer, adhesive layer, charge generating layer, and/or charge transport layer to suppress cracking and delamination problems is not easily accomplished because alteration may adversely affect the overall electrical, mechanical and other properties of the belt such as residual voltage, background, dark decay, flexibility, and the like.

For example, when a flexible imaging member in an electrophotographic machine is a photoreceptor belt fabricated by ultrasonic welding of overlapped opposite ends of a sheet, the ultrasonic energy transmitted to the overlapped ends melts the thermoplastic sheet components in the overlap region to form a seam. The ultrasonic welded seam of a multilayered photoreceptor belt is relatively brittle and low in strength and toughness. The joining techniques, particularly the welding process, can result in the formation of a splashing that projects out from each side of the seam in the overlap region of the belt. Because of the seam overlapping and the seam splashing, a typical flexible imaging member belt is about 1.6 times thicker in the seam region than that of the remainder of the belt for example, a typical belt thickness is about 116 micrometers, reference Example I, whereas the overlapping seam region can be about 186 micrometers.

The photoreceptor belt in an electrophotographic imaging apparatus undergoes bending strain as the belt is cycled over a plurality of support and drive rollers. The excessive thickness of the photoreceptor belt in the seam region due to the presence of the splashing results in a large induced bending strain as the seam travels over each roller.

Generally, small diameter support rollers are highly desirable for simple, reliable copy paper stripping systems in electrophotographic imaging apparatus utilizing a photoreceptor belt system operating in a very confined space. Unfortunately, small diameter rollers, e.g., diameter less than about 0.75 inch (19 millimeters), raise the threshold of mechanical performance criteria to such a high level that photoreceptor belt seam failure can become unacceptable for seamed multilayered belt photoreceptors. For example, when bending over a 19 millimeter diameter roller, a typical photoreceptor belt seam splashing may develop a 0.96 percent tensile strain due to bending. This is 1.63 times greater than a 0.59 percent induced bending strain that develops within the rest of the photoreceptor belt. Since the 0.96 percent tensile strain in the seam splashing region of the belt represents a 63 percent increase in stress placed upon the seam splashing region of the belt, seam cracking and delamination will occur prior to the onset of other photoreceptor belt mechanical failures and become limiting factors that determines the functional life of the belt. Under dynamic fatiguing conditions, the seam provides a focal point for stress concentration and becomes the initiation site for premature material failure, which adversely affect the mechanical integrity of the belt. Thus, the seam overlapped thickness plus the splashing tend to shorten the mechanical life of the seam and service life of the flexible member belt in copiers, duplicators, and printers. In addition to the seam cracking and delamination problems, a negatively charged photoreceptor belt has also been observed to exhibit charge transport layer fatigue cracking failure as a result of repeating tension stress in the charge transport layer when the belt bends and flexes over each belt module support roller during dynamic belt cycling.

In addition to all the above-mentioned mechanical failures, seamed electrophotographic imaging member belts have been found to encounter still another major physical and mechanical shortfall under actual machine operating conditions. This shortfall is manifested as localized imaging member belt set corresponding to each location where the belt makes parking contact with belt module support rollers after each prolonged machine idle period. In a service environment, an imaging member belt mounted on a belt support module is frequently activated into cyclic motion whenever the electrophotographic imaging process is initiated during the working hours of a work week. In reality, these imaging machines are rarely continuously in copying use. It is common for them to sit idle for relatively long periods of time in a ready mode (awaiting next instruction to print an image) and a power saving mode where most of the machine stations are inactivated or otherwise turned down to reduce power consumption. For example, corona generators are generally disabled, and the fuser station in some machines is disabled (i.e., power is cut off and the fuser station cools), while in others the power is reduced to lower the fuser station temperature to a standby temperature to enable relatively rapid return to process temperature. However, during the majority of the time, the machine is idle. While the machine is idle, the belt is stationary and parked over the belt support module rollers. Prolonged stationary parking of the belt while the machine is idle causes development of belt set sites. The time period of idle belt parking can often be extensive, particularly at night, on holidays, and over each week end. Since the imaging member belt comprises layers of thermoplastic polymer materials, it has an inherent propensity to exhibit creep compliance in response to any externally imposed stresses induced by the bending tension and compression effects on the top region and bottom region, respectively, of a segment of the belt while the belt is directly parked over each belt module support roller. After extended periods of machine idle time, each belt segment parked over a support roller develops a set.

A photoreceptor belt set is defined as a characteristic exhibition of localized permanent material deformation caused by an irreversible process of molecular chain slippage in chain entanglement sites which thereby reduces the degree of entanglement in response to the direction of induced bending stress of the affected segment of the belt. The direction of induced bending stress is in conformance to the surface curvature of the belt support roller over which the segment of the belt is bent. The sites are manifestations of physical deviations from the required photoreceptor surface flatness. Belt set in the electrophotographic imaging zone is undesirable because each set creates a small surface protrusion mound or ridge with two adjacent valleys which adversely affect photoreceptor charging uniformity as well as the efficiency of transfer of toner image to paper due to an inability of the photoreceptor to make even and intimate surface contact with the paper. Therefore, the sites of belt set degrade final copy print quality. Since reduction of localized polymer chain entanglement density within a set is a result of irreversible inter polymer chain motion, the sites of belt set induced in the imaging zones affect the belt surface uniformity and also cause early onset of fatigue charge transport layer cracking, as a consequence of interchain separation or total disentanglement which appears as cracks in the coating layer under repeated tension stress. Moreover, if a set is present in the seam region, it hastens the development of seam cracking initiation and seam cracking propagation leading to catastrophic seam delamination during photoreceptor belt machine cycling. Furthermore, the sites of photoreceptor belt set adversely impact belt transporting motion quality, interfere with cleaning blade functions, reduce the critical gap dimension between the belt imaging surface and subsystems such as closely spaced developer applicators, and adversely affect the driving efficiency of a drive roller or rollers for the photoreceptor belt.

Electrophotographic imaging devices also comprise subsystems which generate contaminants which degrade the life of photoconductive imaging members having a surface adjacent to the subsystems. In U.S. Pat. No. 5,376,990, a printing machine is described which includes a second driving mechanism to further drive the imaging member during power down and standby modes, and other critical periods, so as to extend the life of the imaging member by providing a uniform aging effect to the belt. The driving of the photoreceptor is conducted for a preselected duration of time following power off or power saver modes to allow the contaminants, e.g., ozone, nitrous oxide, heat, etc., generated by the subsystems to dissipate whereby the photoreceptor is uniformly aged. Fifteen minutes is generally sufficient time for driving according to U.S. Pat. No. 5,376,990 and ten minutes is preferred. The entire disclosure of U.S. Pat. No. 5,376,990 is incorporated herein by reference. Driving of the photoreceptor belt for a predetermined period of time until contaminants, e.g., ozone, nitrous oxide, heat, etc., generated by the subsystems to dissipate, e.g. 15 minutes, following power off or power saver does not take into consideration the fact that the belt remains stationary on support members such as rollers for many hours after the contaminants generated by the subsystems have dissipated and after the predetermined period of time has expired. The objective of U.S. Pat. No. 5,376,990 is to drive the belt for a pre-selected period of time during machine idling to facilitate uniform imaging member belt aging caused by chemical effects. For example, if a machine is shut down overnight from 6:00 PM to 7:00 AM (13 hours) and the belt is driven for 15 minutes after shut down, the belt would have been stationary for 12 hours and 45 minutes, a time 5,100 percent greater than the brief predetermined driving period after shut down. If shut down extends over a weekend for a period from 6:00 PM Friday evening to 7:00 AM Monday morning, the belt would have been stationary for 54 hours and 45 minutes, a time 29,900 percent greater than the brief predetermined driving period after shut down. The belt photoreceptor will form a set during these long periods of machine shut down.

Under a typical ambient room temperature of about 25° C. and about 37 percent relative humidity, a belt will form an undesirable permanent set when the given segmental area remains parked over a belt support roller for approximately 48 hours (2,880 minutes). This permanent set conforms, to a notable degree, to the shape of the roller on which the belt segment is parked. Since a small roller such as a 19 millimeter diameter roller induces large bending strain/stress in a belt, prolonged belt parking while a machine is idle will exacerbate belt set. Other crucial environmental conditions that have a strong impact on belt set during prolonged belt parking while an imaging machine is idle are factors such as elevated temperature and high humidity. It has been found that a set which exhibits a diameter of curvature of more than about 3 inches does not normally manifest itself into copy print out defects, change the belt surface, alter machine subsystems tolerance, or interfere with cleaning blade functions because the set will effectively be pulled straight under an applied tension of one pound per inch width of belt. However, an imaging member belt with a set having a diameter of curvature of less than about 3 inches can impose problems because the set will exhibit a conspicuous projecting it rounded ridge with adjacent valleys at either side of the mound in the belt surface, all traversing the full width of the belt, when supported in a flat configuration for electrical charging and toner image to paper transfer during electrophotographic imaging processes. Since imaging belt set is a characteristic of interpolymer chain slippage under imposed stress, it is an irreversible process of chain disentanglement which reduces chain entanglement density. Thus, the belt segment location of the set becomes the site for early development of fatigue induced surface cracking.

Therefore, there is an urgent need for improving the physical and mechanical characteristics of seamed flexible imaging member belts to prevent the development of belt set and its associated problems, withstand greater dynamic fatiguing conditions, extend belt service life, as well as overcome any of the previously described shortfalls.

INFORMATION DISCLOSURE STATEMENT

U.S. Pat. No. 5,376,990, issued to Savage on Dec. 27, 1994—An electrophotographic imaging device is disclosed including an photoconductive imaging member having a surface extending approximate to devices generating life degrading contaminants. The printing machine includes a driving unit which continues to drive the imaging member during power down and standby modes, and other critical periods, so as to extend the life of the imaging member.

U.S. Pat. No. 5,240,532, issued to Yu on Aug. 31, 1993—A process for treating a flexible electrostatographic imaging web is disclosed including providing a flexible base layer and a layer including a thermoplastic polymer matrix comprising forming at least a segment of the web into an arc having a radius of curvature between about 10 millimeters and about 25 millimeters measured along the inwardly facing exposed surface of the base layer, the arc having an imaginary axis which traversed the width of the web, heating at least the polymer matrix in the segment to at least the glass transition temperature Tg of the polymer matrix, and cooling the imaging member to a temperature below the glass transition temperature of the polymer matrix while maintaining the segment of the web in the shape of the arc.

Although U.S. Pat. No. 5,376,990 proposes a driving unit to continue imaging belt driving for pre-selected times during machine standby and power down to minimize the effect of chemical attack and extend belt life and U.S. Pat. No. 5,240,532 discloses heat treating a belt seam and the surface of an entire electrostatographic imaging member belt at an elevated temperature above the glass transition temperature Tg of the imaging layer can significantly prevent the early onset of fatigue seam cracking and delamination and imaging layer cracking problems during machine belt cycling, both innovative concepts fail to resolve the imaging belt parking induced permanent belt set issues and their associated problems.

Thus, there is a continuing need for flexible electrostatographic imaging belts having better surface flatness and improved resistance to fatigue charge transport layer cracking and seam cracking/delamination problems as well as improved copy quality printout free of image non-uniformity defects.

SUMMARY OF THE INVENTION

It is, therefore, an object of the present invention to provide an improved belt cycling system for flexible electrostatographic imaging member belt machine operation which overcomes the above-noted deficiencies.

It is yet another object of the present invention to provide a process that prevents the formation of set in a seamless or seamed flexible electrostatographic imaging member belt under machine operation conditions.

It is still another object of the present invention to provide an improved process for imaging systems utilizing a seamed flexible electrostatographic imaging member belt having an ultrasonically welded seam which does not exhibit early development of seam cracking and delamination.

It is another object of the present invention to provide an improved process for imaging systems utilizing a seamed flexible electrostatographic imaging member belt is which exhibits greater resistance to formation of seam area set and belt imaging zone set.

It is yet another object of the present invention to provide an improved flexible electrostatographic imaging member belt functioning condition which eliminates print out copy quality issue.

It is further yet another object of the present invention to provide an improved process for imaging systems utilizing a flexible electrostatographic imaging member belt which provides and maintains belt motion quality.

It is another object of the present invention to provide an improved process for imaging systems utilizing a flexible electrostatographic imaging member belt which extends the mechanical service life of the belt.

The foregoing objects and others are accomplished in accordance with this invention by providing an imaging process comprising providing an electrically powered imaging system comprising a flexible electrostatographic imaging belt comprising at least one layer comprising a thermoplastic polymer matrix, an imaging surface and a back surface, and at least two rotatable support members, each support member having an arcuate contacting surface in contact with the back surface of the imaging belt, providing electrical power to the imaging system, the imaging system having operating modes comprising a copying mode and at least one non-copying mode, and cycling the belt at slow speed around the support members after the imaging system has continuously been in the at least one non-copying mode for at least about 1.5 hours.

Generally, an electrically powered electrostatographic imaging process comprises a copying or imaging mode and a non-copying or non-imaging mode. The expression "copying mode" as employed herein is defined as the mode when images are actually formed by forming an electrostatic latent image and developing the latent image with marking particles to form a toner particle image in conformance with the latent image. This marking particle image is usually transferred to receiving member which can be a final document or transferred to an intermediate image transfer member from which the marking particle image is transferred to a final document.

The expression "non-copying mode" as employed herein is defined as the mode when the imaging system is idle and not making images. Depending upon the particular system used, the non-copying mode may include one or more specific modes, including, for example, a copying ready mode, a power saving mode and a power off mode.

In the copying ready mode, the imaging system is ready to immediately respond to a copy command because all the subsystems, such as the fuser, exposure lamp and the like are warm and ready to instantly make an electrostatographic copy. The copying ready mode includes the point in time after a machine is turned on and all the subsystems are ready for immediately performing copying activities. The copying ready mode also includes the times between actual copying activities and when all the subsystems are ready for immediately performing copying functions.

In some imaging systems the presence of relatively high energy consumption components justify the use of a power saving mode. In the power saving mode, designated subsystems which consume large amounts of energy and any other selected subsystem are either turned off completely or put into a warming mode where time is required to ramp up to a fully ready to copy state, but such warming up time is less than the time required to warm up from a cold imaging system in a fully off mode. Thus, for example, during a power saving mode, a fuser roller may be kept warm at a lower temperature than the normal fully operational fusing temperature. Therefore, for imaging systems that have a power saving mode feature, the imaging system will normally be automatically shifted from the copying ready mode to the power saving mode by the controller after the system has been idle for a predetermined time in the fully operational and full power consumption state of the copying ready mode.

BRIEF DESCRIPTION OF THE DRAWINGS

A more complete understanding of the present invention can be obtained by reference to the accompanying drawings wherein.

The accompanying drawings illustrate embodiments of the present invention.

These figures merely schematically illustrate the invention and are not intended to indicate relative size and dimensions of the device or components thereof. The same numerical numbers identify the same material parts or components.

DETAILED DESCRIPTION OF THE PREFERRED EMBODIMENTS

Figure 1:
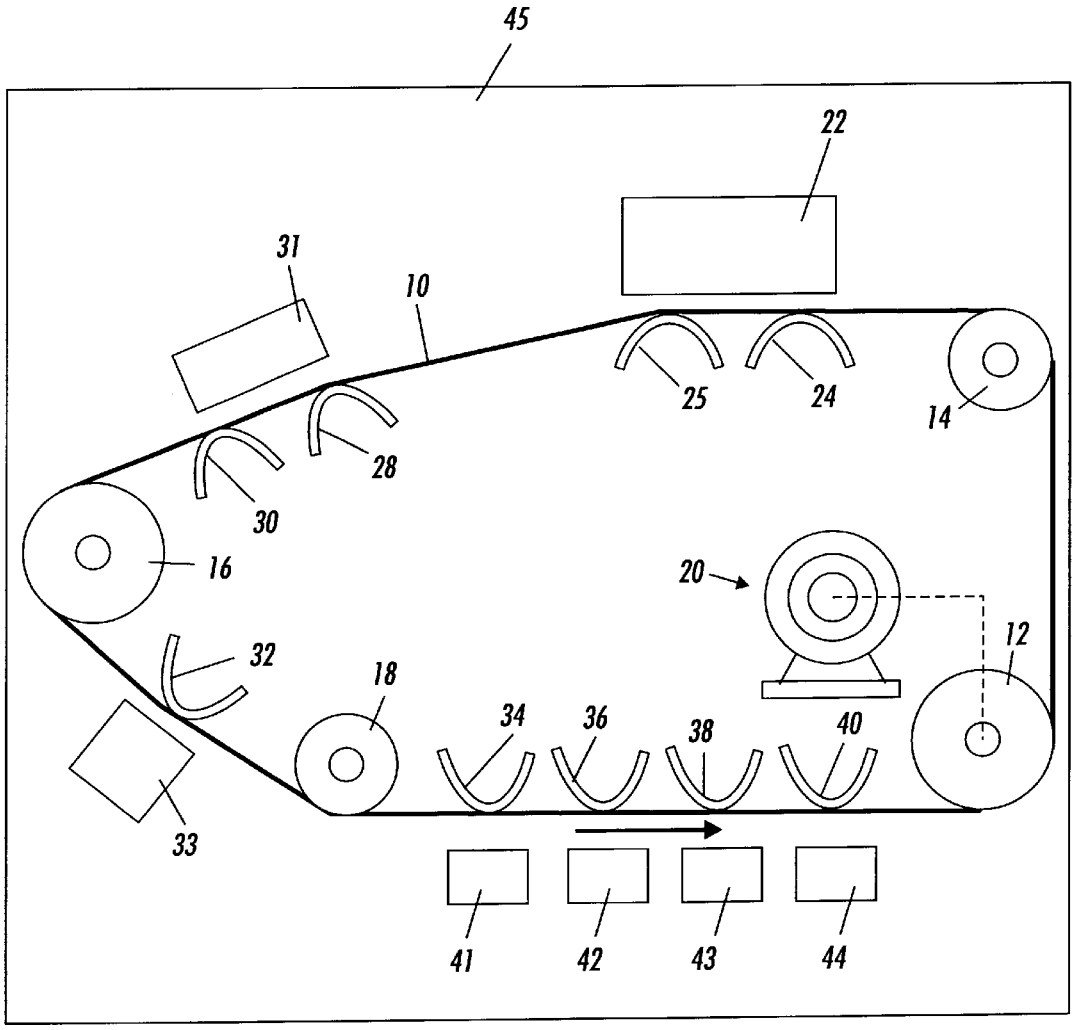
FIG. 1 PRIOR ART
FIG. 1 is a schematic representation of a typical electrophotographic imaging belt module design of prior art.

FIG. 1 is a side view of a prior art electrophotographic imaging belt module, used in a multiple pass full color imaging system. A photoreceptor belt 10 is entrained about a drive roller 12, a stripper roller 14, a tension roller 16, and an encoder roller 18. The stripper roller 14, tension roller 16, and encoder roller 18 are mounted on a frame (not shown) so that they are freely rotatable. The tension roller 16 is supported on the frame by conventional spring loaded pivotable arms (not shown). Tension roller 16 provides a uniform force against the photoreceptor belt 10 to maintain desirable belt tension for proper electrophotographic imaging operations when the belt 10 is transported in the direction shown by the arrow. A motor 20 is connected by a conventional gear train to the drive roller 12 to provide the drive power needed to transport the photoreceptor belt 10. Cleaning station 22 removes toner residue from the photoreceptor belt 10 after each complete image copying process.

Backer bars 24 and 25 are employed at the cleaning station to improve cleaning efficiency. Backer bars 28 and 30 facilitate uniform electrical charging of the imaging surface of photoreceptor belt 10 by charging device 31. Backer bar 32 enhances imaging exposure by exposure device 33. Backer bars 34, 36, 38, and 40 are positioned at the backside of photoreceptor belt 10 opposite to the black and the three primary color stations 41, 42, 43 and 44, respectively, to ensure photoreceptor surface flatness for good toner image development. All of the illustrated components are directly or indirectly supported on a frame 45.

Figure 2:
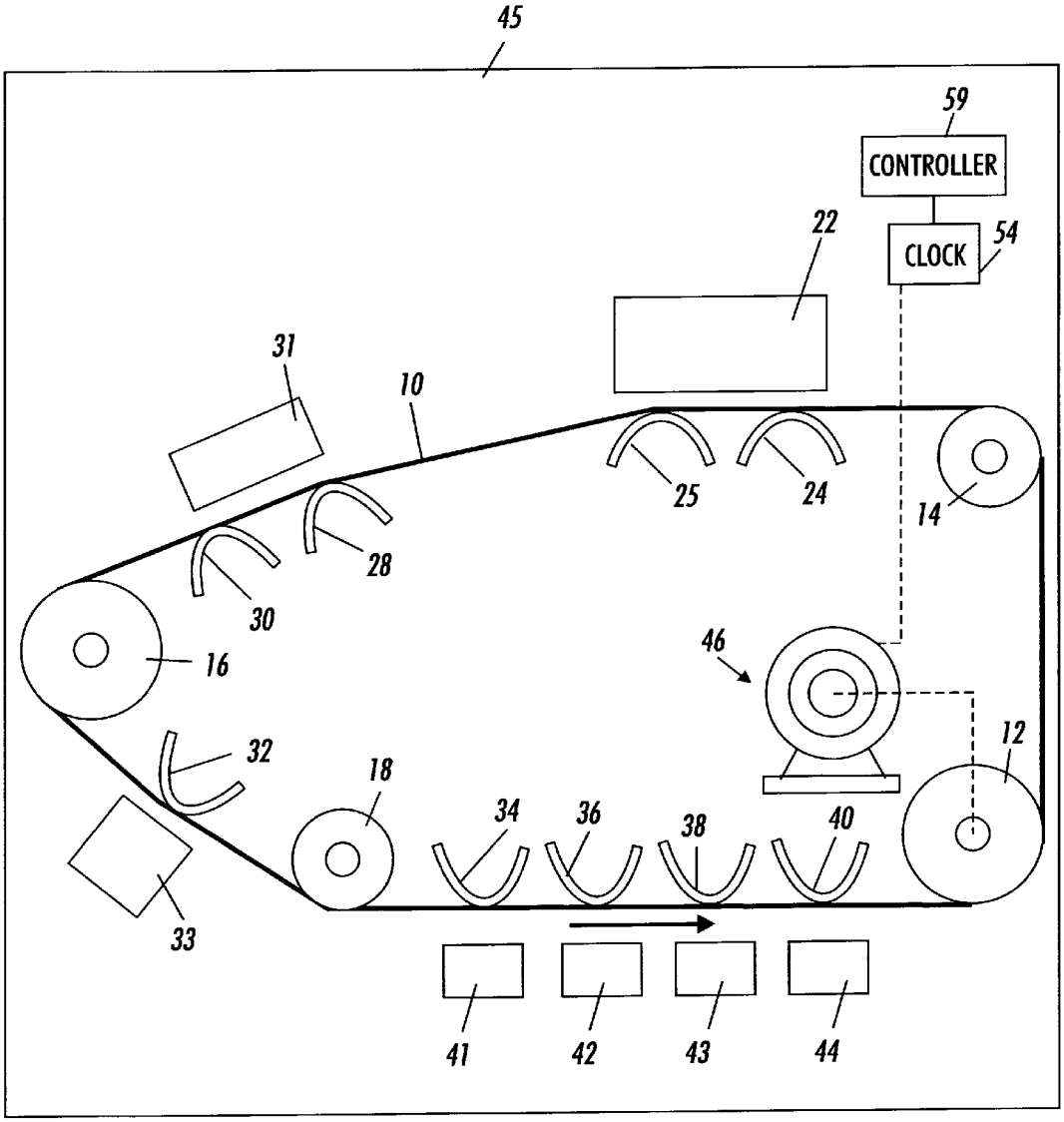
FIG. 2 is a depiction of the same belt module except that the driving motor is automatically controlled in accordance with the conditions of the present invention including providing a driving motion to advance the belt during non-imaging periods of the non copying mode.

FIG. 2 illustrates a photoreceptor belt module design similar to that shown in FIG. 1 with the exception that the drive system for the photoreceptor belt 10 has been modified to incorporate a multi speed driving capacity stepper motor 46 which is activated by the system of the present invention which comprises a programmable controller 59 which controls in cooperation with clock signal generator 54 for effecting the actuation of stepper motor 46 to operate at one of at least two belt drive speeds. Programmable controller 59 is connected to clock signal generator 54 and to stepper motor 46. The programmable controller 59 is a conventional microprocessor system which is preferably programmed to control all machine steps and functions described herein. In response to predetermined informational signals, the controller 59 can implement a predetermined actuation signal to motor 46 to run at a first predetermined speed whenever the imaging machine is turned on and activated to perform electrophotographic imaging cycles. Controller 59 can also implement a control signal to the motor 46 to run the photoreceptor belt 10 at any predetermined cycling speed, or otherwise, to inactivate the motor 46 and cease the movement of belt 10.

Controller 59, after one or more of the predetermined signals are received from one of several informational signal sources, generates a control signal to drive the belt 10. For example, the preselected signal can include ones from a conventional control panel (not shown) indicating a power off condition (i.e., the power is to be turned off). In this case, for safety and other considerations, two forms of power off could be made available to the user so that an immediate and complete power down could also be enabled as well as one where, prior to the controller 59 initiating a complete cessation of power down, the controller 59 initiates a power off routine. In such power off routine, it is preferred that the power is removed from essentially all components of the machine, except the motor 46, which is driven according to a power off mode, as will be described below. Further, it will also be appreciated that for safety and other reasons known interlock type mechanisms and sensors can be employed to override the mode to be described. A second informational signal source to trigger control signals to the motor 46 could also include the clock signal generator 54. In this embodiment, the clock signal generator 54 generates a stream of signals to the controller 59 to provide timing for the machine. Thus, when a sufficient number of timing signals have occurred between ordinary operations (i.e., printing of images on a sheet), a buffer or other counting or accumulating device can be employed for counting purposes, the controller 59 enters a power saver routine and initiates control signals to the motor 46 to drive the belt 10 at a slow cycling speed according to a predetermined power saver mode, with driving of the belt being continued and constant in all power saver modes. The expression "constant" as employed herein to describe the slow belt cycling speed is intended to include nonstop movement as well as to include an intermittent stop and go movement, where the duration of belt movement is greater than about 60 minutes (one hour) and stationary for less than about 90 minutes (1.5 hours). When the imaging machine is in a power saver mode, a constant nonstop slow speed belt cycling motion is preferred for the entire duration of the power saver mode. However, for power off mode period, which normally involves a stationary imaging member belt being parked for long durations of time that extend through nights, holidays, and weekends, an intermittent stop and go movement format is preferred to minimize accumulation of unnecessary imaging belt fatigue cycles.

In use, the informational signals from the signal generating device (e.g., an optional control panel and/or the clock signal generator 54 provide input to the controller 59 as to the status of the machine. In response to these signals, the controller 59 actuates the motor 46. For example, during activation of a power off mode, prior to the control signal from the controller 59 to totally cut power to the entire machine, but with power availability to motor 46 being maintained, the belt 10 is driven at an extremely slow speed so as to slowly cycle the belt 10 even after power is cut to most, if not all, of the rest of the subsystems in the machine. It is preferred that power be supplied to the controller during the power off mode, particularly when the belt 10 is driven intermittently in a stop and go format at an extremely slow speed to slowly cycle the belt 10. Alternatively, though less desirable, a driven motor in combination with a transmission may be utilized to achieve multiple drive speeds. If the machine is to be unplugged because it must be moved or for some other similar reason where the belt will be stationary for longer than about 10 hours under normal room ambient condition of 25° C. and 37 percent relative humidity, the belt tension supplying roller in the belt support module should be adjusted to totally loosening the belt, or alternatively, the belt should be removed from the machine to prevent set from forming.

It is preferred that the slow belt cycling speed for the power saver and power off modes be essentially the same, although in certain instances the routine may be different to account for the differences in the constituent elements and the construction of the machine. In any event, the cycling routine should continue for most of or during the entire duration of the power saver or power off mode periods. The cycling routine may be of a periodic nature where the belt 10 is driven intermittently in a partial cycle or stop and go cycling format during most of or during the entire duration of any copying ready, power saver or power off mode period exceeding about 1.5 hours. In the partial cycle format, the belt may be moved for between about 1 hour and about 3 hours and be stationary for less than about 1.5 hours. When the belt is stationary for more than about 1.5 hours, the formation of set may become probable, particularly under typical elevated temperature machine operating conditions or during hot and humid summertime machine power off mode periods. In the slow belt cycling mode, the direction of belt cycling may be either in the same or opposite direction as the direction used for forming images.

Thus, activation of motor 46 drives belt 10 at the first predetermined speed during the electrophotographic imaging mode. Normally, the machine is turned on during work days. However, during a work day when the imaging machine is idle for a long period of time in a copying ready mode for 1.5 hours, or idle for a time of less than 1.5 hours with a power saver mode being called into action, or even idle for a time of less than 1.5 hours when a turn off (power off mode) command is activated to shut off the machine, the controller 59 and clock 54 may be programmed to automatically issue an activation command to drive motor 46 to continuously advance the belt 10 at a second predetermined continuous slow or intermittent slow cycling speed described in detail above. Alternatively, the actuation of predetermined slow speed belt motion may be set to start after about 1.5 hours of imaging machine idle in a copying ready mode, or idle in copying ready mode to power saver mode, or idle in copying ready mode to power saver mode to power off mode, or idle in copying ready mode to power off mode. When the machine is returned back to the active image forming mode, the controller 59 and clock 54 return motor 46 to the original first predetermined normal imaging speed.

If an imaging machine equipped with an automatic power saver mode is activated by the controller when the machine is idled for a predetermined period of time of less than 1.5 hours, the power saving control switch may also simultaneously activate the slow motor speed mode to advance belt 10. Likewise, if the machine is turned off in less than 1.5 hours of idle or at any instant, the power off mode switch will also turn on the motor to initiate slow belt speed cycling. In other words, the existing power saver and power off switches may be assigned a dual operational function.

For week nights, holidays, and weekends, when the machine is turned off (power off mode) by an operator or when the automatic power saver mode is activated by the controller, the motor preferably remains under the control of the controller.

Thus, the process of this invention senses an extended copying ready mode, power saver mode, power off mode, or any other extended machine idle condition and ensures that in any idle period exceeding about 1.5 hours, the belt drive motor will be activated to provide the desired slow belt drive speed. Thus, if the belt drive motor is not already running at the slow belt drive speed, it will be activated to provide the desired slow belt drive speed if the machine has idled for about 1.5 hours from the time the last copy was imaged regardless of whether the machine is in the copying ready mode, the power saving mode or the power off mode. If the belt drive motor is already running at the slow belt drive speed, power will continue to be supplied to the motor to continue the desired slow belt drive speed if the machine has idled for about 1.5 hours from the time the last copy was imaged regardless of whether the machine is in the copying read mode, the power saving mode or the power off mode. For machines equipped with a power saving mode activation control programmed to be automatically activated at a point in time which is less than 1.5 hours of machine idle, it is preferred that slow speed belt cycling is simultaneously initiated by the activation of the power saving mode, if slow speed belt cycling has not already been initiated. Similarly, actuation of slow speed imaging member belt cycling may automatically be initiated by actuation of the power off or power down mode through manual operation of a shut-off switch, if slow speed belt cycling has not already been initiated. Slow imaging belt cycling beyond a predetermined imaging idle time eliminates permanent belt set. Satisfactory results are achieved by moving the belt at a controlled slow speed of between about 250 millimeters per hour and about 2 millimeters per hour. Preferably the slow belt speed is from about 127 millimeters per hour (5 inches per hour) to about 17.8 millimeters per hour (0.7 inches per hour) to provide best results. Based on mechanical belt life considerations, selection of a slow belt motion speed exceeding the upper limit of about 250 millimeters per hour will have the negative impact of adding an excessive number of unnecessary fatigue cycles which shortens the mechanical service life of the imaging belt, while a slow belt drive speed of less than the lower limit of about 2 millimeters per hour will yield no beneficially results. Although a variance of slow belt rotation speed may be used at any point in time to achieve the belt set suppression objectives, selection of a single constant slow belt driving speed for the entire duration of the machine idle period is more practical. To achieve optimum results, a slower slow belt motion speed is preferred for machine power down or shut-off modes than when the imaging machine is operating under the copying ready mode or the power saving mode. To effect simplification and cost saving measures, the initiation of slow speed belt motion is preferably simultaneously controlled by the same activation mechanism used for switching on the power saving mode or the machine power off mode. Since the slow belt cycling of this invention may be activated and controlled by the power saving mode mechanism or the power down machine shut-off switch, the slow belt cycling mode can be instantly suspended upon termination of the power saving mode or after the machine power is turned back on and at the moment when the electrophotographic imaging process is initiated. Where actuation of the slow speed belt cycling mode is triggered by a separate control mechanism when the machine idle time reaches 1.5 hours from the last formation of a copy or initial machine turn on and the machine is in the copying ready mode, the slow speed belt cycling will automatically be terminated when the machine is placed in the image copying mode.

A number of examples are set forth hereinbelow and are illustrative of different compositions and conditions that can be utilized in practicing the invention. All proportions are by weight unless otherwise indicated. It will be apparent, however, that the invention can be practiced with many types of combinations and conditions and can have many different uses in accordance with the disclosure above and as pointed out hereinafter.

EXAMPLE I

An electrophotographic imaging member web was prepared by providing a roll of titanium coated biaxially oriented thermoplastic polyester (Melinex, available from ICI Americas Inc.) substrate having a thickness of 3 mils (76.2 micrometers) and applying thereto, using a gravure applicator, a solution containing 50 parts by weight 3-aminopropyltriethoxysilane, 50.2 parts by weight distilled water, 15 parts by weight acetic acid, 684.8 parts by weight of 200 proof denatured alcohol, and 200 parts by weight heptane. This layer was then dried to a maximum temperature of 290° F. (143.3° C.) in a forced air oven. The resulting blocking layer had a dry thickness of 0.05 micrometer.

An adhesive interface layer was then prepared by applying to the blocking layer a wet coating containing 5 percent by weight, based on the total weight of the solution, of polyester adhesive (Mor-Ester 49,000, available from Morton International, Inc.) in a 70:30 volume ratio mixture of tetrahydrofuran/cyclohexanone. The adhesive interface layer was dried to a maximum temperature of 275° F. (135° C.) in a forced air oven. The resulting adhesive interface layer had a dry thickness of 0.07 micrometer.

The adhesive interface layer was thereafter coated with a photogenerating layer containing 7.5 percent by volume trigonal selenium, 25 percent by volume N,N'-diphenyN,N'-bis(3-methylphenyl)-1,1'-biphenyl-4,4'-diamine, and 67.5 percent by volume polyvinylcarbazole. This photogenerating layer was prepared by introducing 160 gms polyvinylcarbazole and 2,800 mls of a 1:1 volume ratio of a mixture of tetrahydrofuran and toluene into a 400 oz. amber bottle. To this solution was added 160 gms of trigonal selenium and 20,000 gms of ⅛ inch (3.2 millimeters) diameter stainless steel shot. This mixture was then placed on a ball mill for 72 to 96 hours. Subsequently, 500 gms of the resulting slurry were added to a solution of 36 gms of polyvinylcarbazole and 20 gms of N,N'-diphenyl-N,N'-bis(3-methylphenyl)-1,1'-biphenyl-4,4'-diamine dissolved in 750 mls of 1:1 volume ratio of tetrahydrofuran/toluene. This slurry was then placed on a shaker for 10 minutes. The resulting slurry was thereafter applied to the adhesive interface by extrusion coating to form a layer having a wet thickness of 0.5 mil (12.7 micrometers). However, a strip about 3 mm wide along one edge of the coating web, having the blocking layer and adhesive layer, was deliberately left uncoated by any of the photogenerating layer material to facilitate adequate electrical contact with the ground strip layer that is applied later. This photogenerating layer was dried to a maximum temperature of 280° F. (138° C.) in a forced air oven to form a dry thickness photogenerating layer having a thickness of 2.0 micrometers.

This coated imaging member web was simultaneously overcoated with a charge transport layer and a ground strip layer by co-extrusion of the coating materials. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon 5705, a polycarbonate resin having a molecular weight of about 120,000 commercially available from Farbensabricken Bayer A. G. The resulting mixture was dissolved to give 15 percent by weight solid in methylene chloride. This solution was applied on the photogenerator layer by extrusion to form a coating which upon drying gave a thickness of 24 micrometers.

The strip, about 3 mm wide, of the adhesive layer left uncoated by the photogenerator layer, was coated with a ground strip layer during the co-extrusion process. The ground strip layer coating mixture was prepared by combining 23.81 gms. of polycarbonate resin (Makrolon 5705, 7.87 percent by total weight solids, available from Bayer A. G.), and 332 gms of methylene chloride in a carboy container. The container was covered tightly and placed on a roll mill for about 24 hours until the polycarbonate was dissolved in the methylene chloride. The resulting solution was mixed for 15–30 minutes with about 93,89 gms of graphite dispersion (12.3 percent by weight solids) of 9.41 parts by weight graphite, 2.87 parts by weight ethyl cellulose and 87.7 parts by weight solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion with the charge transport layer, to the electrophotographic imaging member web to form an electrically conductive ground strip layer having a dried thickness of about 14 micrometers.

The resulting imaging member web containing all of the above layers was then passed through a maximum temperature zone of 240° F. (116° C.) in a forced air oven to simultaneously dry both the charge transport layer and the ground strip.

An anti-curl coating was prepared by combining 88.2 gms of polycarbonate resin (Makrolon 5705, available from Goodyear Tire and Rubber Company) and 900.7 gms of methylene chloride in a carboy container to form a coating solution containing 8.9 percent solids. The container was covered tightly and placed on a roll mill for about 24 hours until the polycarbonate and polyester were dissolved in the methylene chloride. 4.5 gms of silane treated microcrystalline silica was dispersed in the resulting solution with a high shear dispersion to form the anti-curl coating solution. The anti-curl coating solution was then applied to the rear surface (side opposite the photogenerator layer and charge transport layer) of the electrophotographic imaging member web by extrusion coating and dried to a maximum temperature of 220° F. (104° C.) in a forced air oven to produce a dried coating layer having a thickness of 13.5 micrometers.

EXAMPLE II

The electrophotographic imaging member web of Example I having a width of 335 millimeters, was cut into two separate rectangular sheets of precisely 641 millimeters in length. The opposite ends of each imaging member were overlapped 1 mm and joined by an ultrasonic energy seam welding process using a 40 Khz horn frequency to form two seamed electrophotographic imaging member belts. These seamed belts are to be subjected to various machine condition tests.

EXAMPLE III

To determine the effect of imaging member belt set induced by prolong belt parking over belt module support rollers, one of the seamed electrophotographic imaging member belts of Example II was mounted to encircle the belt around a bi-roller belt support module containing two 19 mm diameter belt support rollers. The mounting of the imaging member belt, under one pound per inch width applied belt tension, was carried out to intentionally park the seam of the belt directly over one support roller and the module carrying the belt was then, on a Friday afternoon, stored inside a 90° F./90% relative humidity controlled chamber over the weekend to equate machine off time under environmental conditions simulating a hot and humid summer time. The belt was removed from the belt support module after approximately 3 days of weekend parking and then examined for the extent of imaging member belt set while it stood free and unrestrained on a bench top in room ambient conditions. A very pronounced set at the seam area, with partial conformance to is the 19 mm belt support roller, and a similar set area, formed at a location 180° opposite to the seam in the imaging zone of the belt, were clearly conspicuous by visual observation. Both areas of imaging member belt set were measured to have a diameter of curvature of approximately 45 mm.

The second seamed electrophotographic imaging member belt of Example II was mounted in the same manner to encircle the belt around the same bi-roller belt support module. The mounted imaging member belt over the belt support module was stored inside the same temperature/humidity chamber to again simulate 3 day summertime weekend conditions, but with the exception that the belt support module was programmed to cycle the imaging member belt at a constant slow belt speed motion of about 3.4 inches per hour for the entire duration of the temperature/RH storage test. After removal from the belt support module at the termination of the weekend storage test, no visible evidence of imaging member belt set was observed under close examination. This result indicated that a constant slow speed belt movement was effective to prevent the development of a belt set problem caused by material creep compliance under the effects of bending stress/strain due to prolonged stationary parking of the imaging belt over belt support module rollers.

EXAMPLE IV

The electrophotographic imaging member belt having the characteristic belt set of Example III was evaluated for the effects of a belt set site on copy image quality printout using an electrophotographic imaging print testing process employing a scorotron charging device, under a one pound per inch applied belt tension and belt transport speed of 7.5 inches per second. The resulting copy print out showed the direct impact of the belt set area to defects in the copy. More specifically, the belt set was printed out as an intense image line sandwiched between two deletion lines running across the full width of the print. These defects were found to line-up perfectly and correspond with the rounded ridge like protrusion and the two adjacent valleys of the set; since the rounded ridge like protrusion could have higher charge acceptance due to its distance to the charging device to give a higher intensity line printout, whereas the valleys were not only physically more distant from the charging device, but also in less intimate contact with the receiving paper during transfer to hinder toner image transfer efficiency thereby printed out as copy deletion lines.

This electrophotographic imaging member belt was then cycle tested for mechanical failure. The onset of seam area cracking was noted after about 28,000 fatigue belt cycles. Charge transport layer cracking, seen only in the restricted set area 180° opposite to the seam, occurred after about 38,000 belt cycles.

In a parallel belt cycling test repeatedly carried out for the second electrophotographic imaging member belt free of belt set, observation of seam area crack initiation in the seam area was evident after about 37,000 fatigue belt cycles. While the appearance of charge transport layer fatigue cracking occurred after about 46,000 belt cycles.

The dynamic fatigue belt cycling test results obtained show the detrimental electrical, print quality, and mechanical impact caused by the imaging member belt set problem could prematurely shorten the belt service life. These experimental results also demonstrate and support the concept of the present invention that continuous slow speed cycling of a flexible imaging member belt is a simple and effective process to eliminate the undesirable impact of induced set in a flexible imaging belt due to prolonged belt parking while an imaging machine is idle.

Although the invention has been described with reference to specific preferred embodiments, it is not intended to be limited thereto, rather those having ordinary skill in the art will recognize that variations and modifications may be made therein which are within the spirit of the invention and within the scope of the claims.

What is claimed is:

1. A process comprising:

providing an electrically powered imaging system comprising a flexible electrostatographic imaging belt comprising at least one layer comprising a thermoplastic polymer matrix, an imaging surface and a back surface, and at least two rotatable belt support members, each support member having an arcuate contacting surface in contact with the back surface of the imaging belt;

providing electrical power to the imaging system, the imaging system having operating modes comprising a copying mode and at least one non-copying mode; and cycling the belt at slow speed around the belt support members after the imaging system has continuously been in the at least one non-copying mode for at least about 1.5 hours, wherein the slow speed belt cycling is continuous and wherein the slow speed belt cycling is between about 250 millimeters per hour and about 2 millimeters per hour.

2. A process according to claim 1 comprising discontinuing the slow speed belt cycling when the imaging system is in the copying mode.

3. A process according to claim 2 comprising driving at least one of the rotatable belt support members to initiate the slow speed cycling of the belt around the support members.

4. A process according to claim 1, wherein the slow speed belt cycling is between about 127 millimeters per hour and about 17.8 millimeters per hour.

5. A process according to claim 1 wherein the slow speed belt cycling is intermittent with belt stoppages.

6. A process according to claim 5 wherein each belt stoppage is less than about 90 minutes.

7. A process according to claim 1 including initiating slow speed belt cycling immediately upon initiation of said at least one non-copying mode.

8. A process according to claim 1 wherein including initiating slow speed belt cycling about 1.5 hours after initiation of said at least one non-copying mode.

9. A process according to claim 1 wherein the at least one non-copying mode comprises a copying ready mode.

10. A process according to claim 1 wherein the at least one non-copying mode comprises a power saving mode.

11. A process according to claim 1 wherein the at least one non-copying mode comprises a power off mode.

12. A process according to claim 1 including cycling the belt at slow speed is in one direction.

13. A process according to claim 12 wherein the one direction is the opposite direction as when cycling the belt during imaging cycles.

14. A process according to claim 1 wherein cycling the belt at slow speed is initially in one direction and thereafter in the opposite direction.

15. A process according to claim 1 wherein at least one belt support members is a roller having a diameter between about 19 millimeters and about 50 millimeters.

16. A process according to claim 1 wherein the belt is an electrophotographic imaging member.

17. A process according to claim 1 wherein the belt is an electrographic imaging member.

18. A process according to claim 1 wherein the belt is an intermediate transfer member.

19. An imaging process comprising:

providing an electrically powered imaging system comprising a flexible electrostatographic imaging belt comprising at least one layer comprising a thermoplastic polymer matrix, an imaging surface and a back surface, at least two support members of an imaging system, each belt support member having an arcuate contacting surface in contact with the back surface of the imaging belt;

providing electrical power to the imaging system, the imaging system having operating modes comprising a copying mode and non-copying modes selected from the group consisting of copy ready mode, power saving mode, power off mode, and combinations thereof, initiating slow speed belt cycling around the support members after the imaging system has continuously been in the copy ready mode, power saving mode or power off mode for at least about 1.5 hours wherein the slow speed belt cycling is between about 250 millimeters per hour and about 2 millimeters per hour; and discontinuing slow speed belt cycling when the imaging system is in the active copying mode.

* * * * *